US006862010B2

(12) United States Patent
Nicolas et al.

(10) Patent No.: US 6,862,010 B2
(45) Date of Patent: Mar. 1, 2005

(54) METHOD AND DEVICE FOR CONTROLLING THE VOLTAGE OF A MATRIX STRUCTURE ELECTRON SOURCE, WITH REGULATION OF THE EMITTED CHARGE

(75) Inventors: Pierre Nicolas, St. Egreve (FR); Denis Sarrasin, Sassenage (FR)

(73) Assignee: Commissariat a l'Energie Atomique, Paris (FR)

( * ) Notice: Subject to any disclaimer, the term of this patent is extended or adjusted under 35 U.S.C. 154(b) by 72 days.

(21) Appl. No.: 10/293,665

(22) Filed: Nov. 12, 2002

(65) Prior Publication Data

US 2003/0094930 A1 May 22, 2003

(30) Foreign Application Priority Data

Nov. 16, 2001 (FR) ..... 01 14839

(51) Int. Cl.[7] ..... G09G 3/22; G05F 1/40

(52) U.S. Cl. ..... 345/74.1; 323/268

(58) Field of Search ..... 323/266, 268, 323/271, 273; 345/74.1, 75.2, 76–80, 84, 85, 105

(56) References Cited

U.S. PATENT DOCUMENTS 5,600,343 A * 2/1997 Sarrasin ..... 345/75.2
5,856,812 A 1/1999 Hush et al. ..... 345/74
5,907,313 A * 5/1999 Kubota et al. ..... 345/100
6,020,864 A 2/2000 Bancal ..... 345/74
6,054,973 A * 4/2000 Hughes et al. ..... 345/97
6,204,834 B1 3/2001 Baker et al. ..... 345/74
6,417,825 B1 * 7/2002 Stewart et al. ..... 345/77

FOREIGN PATENT DOCUMENTS

EP 0 688 035 A1 6/1995 ..... H01J/31/12

* cited by examiner

*Primary Examiner*—Matthew V. Nguyen
(74) *Attorney, Agent, or Firm*—Thelen Reid & Priest, LLP

(57) ABSTRACT

A method controls voltage of a matrix structure electron source. The method includes setting the emission of electrons by applying potentials on the selected line and column (s) at a value allowing this emission, maintaining these potentials at their value throughout the duration of the emission, carrying out a sampling and analog memorisation of the emission current of each pixel of the column(s) at the start of the emission time, and using another current supplied by a current generator that is proportional to the value of the measured emission current circulating the column(s); and measuring the quantity of charge delivered, during all or part of the remaining line time, by each current generator, and when this quantity reaches a required value, commuting the potential of the column associated to the current generator to a value that ensures the blocking of the emission of electrons of the pixel of this column.

9 Claims, 10 Drawing Sheets

A
B
C
D
E
F
G
H
I
J
$t_{lig}$
$V_{Li}$
$V_{ls}$
$V_{lns}=0$
$t_o$
t
S1
S2
$t_{off}$
Su1
$t_{on}$
$t_{stab}$
Vcj
Vc-off
Vc-on =0
S4
Su2
S3
Su3
Vref
Scomp A
B
C
D
E
F
G
H
I
$t_{lig}$
$V_{Li}$
$V_{ls}$
$V_{ins}$ =0
$t_o$
t
S1
S2
$t_{off}$
Su1
$t_{on}$
$t_{stab}$
$V_{cj}$
$V_{c\text{-}off}$
$V_{c\text{-}on}$ =0
S4
S3
Su3
Vref
Scomp

METHOD AND DEVICE FOR CONTROLLING THE VOLTAGE OF A MATRIX STRUCTURE ELECTRON SOURCE, WITH REGULATION OF THE EMITTED CHARGE

"This application is claims priority of French application no. 01 14839 which was filed on Nov. 16, 2001, and was not published in English."

TECHNICAL FIELD

The present invention concerns a method and a device for controlling the voltage of a matrix structure electron source, with regulation of the emitted charge.

STATE OF THE PRIOR ART

Various electron sources or electron emitter devices are known. These known devices are based on physical principles that can be very different from one another.

For example, hot cathodes, photoemissive cathodes and field effect microdot cathodes are known, as described in the document referenced (1) at the end of the description, as well as field effect nanotube devices, as described in document referenced (2), graphite type or diamond type flat sources of electrons, as described in the document referenced (3) and LED (light emitting diode) devices.

Such electron sources mainly find applications in the display field with flat screens but also in other fields, for example the fields of physical instrumentation, lasers and X-ray emission sources, as described in the document referenced (4).

The embodiments of the invention that are described hereafter are taken in the vast field of display, which particularly includes flat screens. The present invention is not however limited to this field and applies to any device using one or several electron sources (including in particular the case of a 1 line×1 column matrix). This is the case, for example, in a monopixel screen that operates in pulsed mode.

Figure 1:
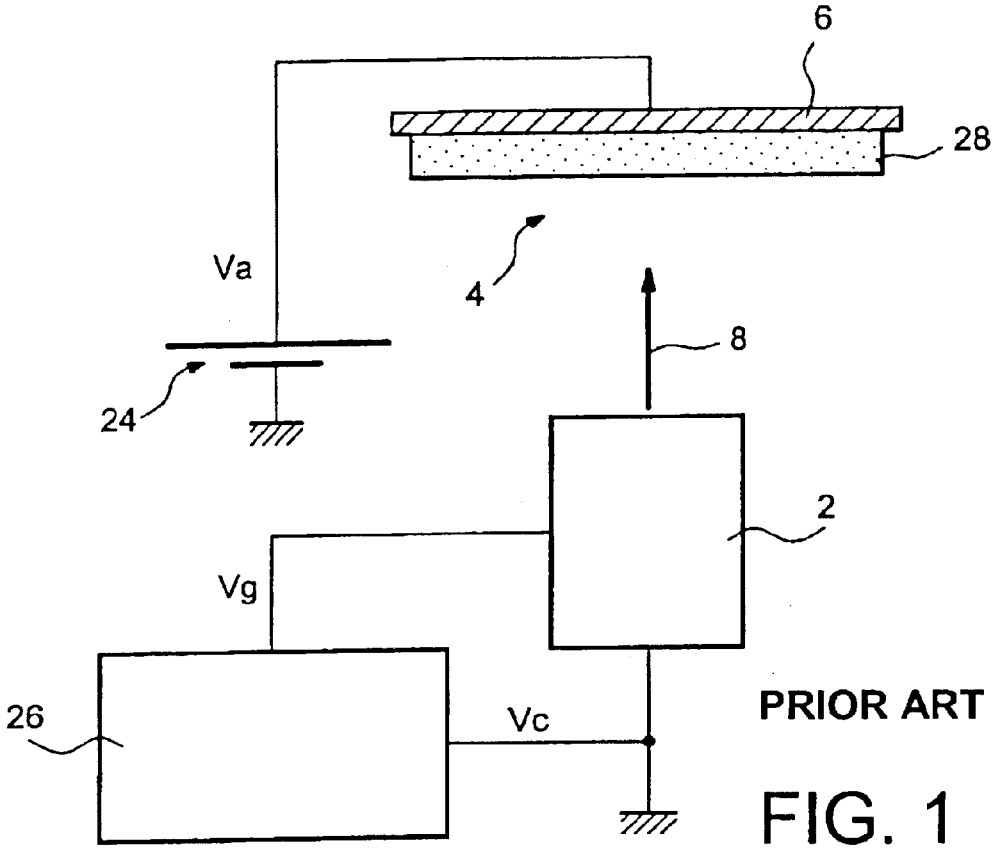
PRIOR ART FIG. 1

FIG. 1 schematically illustrates the operating principle of a display screen that uses a field emission electron source 2. Said screen comprises an anode 4 with an anode conductor 6. The cathode, which constitutes the electron source 2 is generally voltage controlled. Under the influence of this voltage, it emits a flow of electrons 8.

Figure 2:
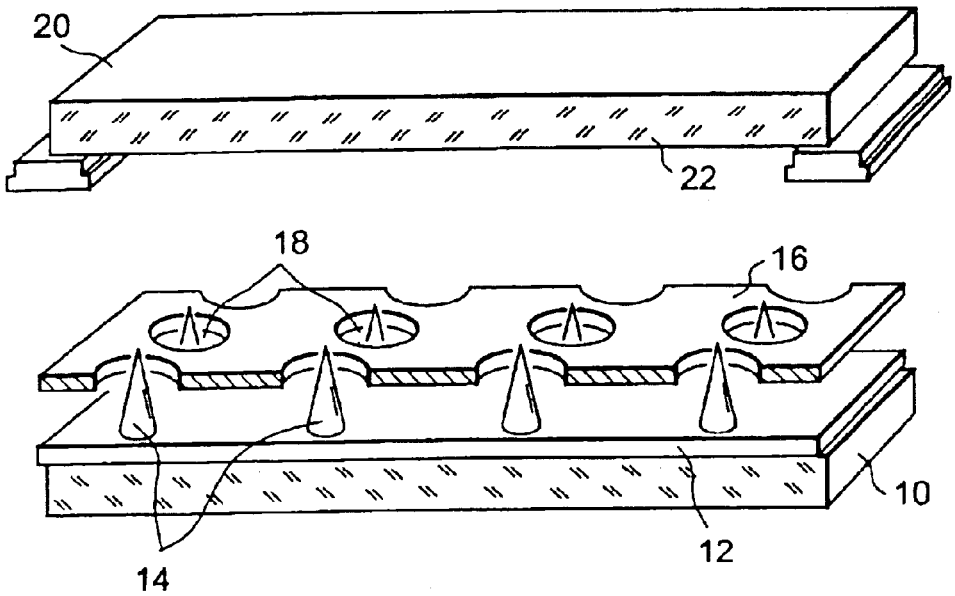
FIG. 2 PRIOR ART

In the specific case of a microdot screen, as illustrated in FIG. 2, said screen comprises a cathode made up of a substrate 10, equipped with cathodic conductors 12 on which are formed microdots 14, and grids 16 formed above the cathodic conductors and provided with holes 18 opposite the microdots. Said screen also comprises an anode with a substrate 20 and an anode conductor 22 that is placed opposite the grids 16.

Figure 3:
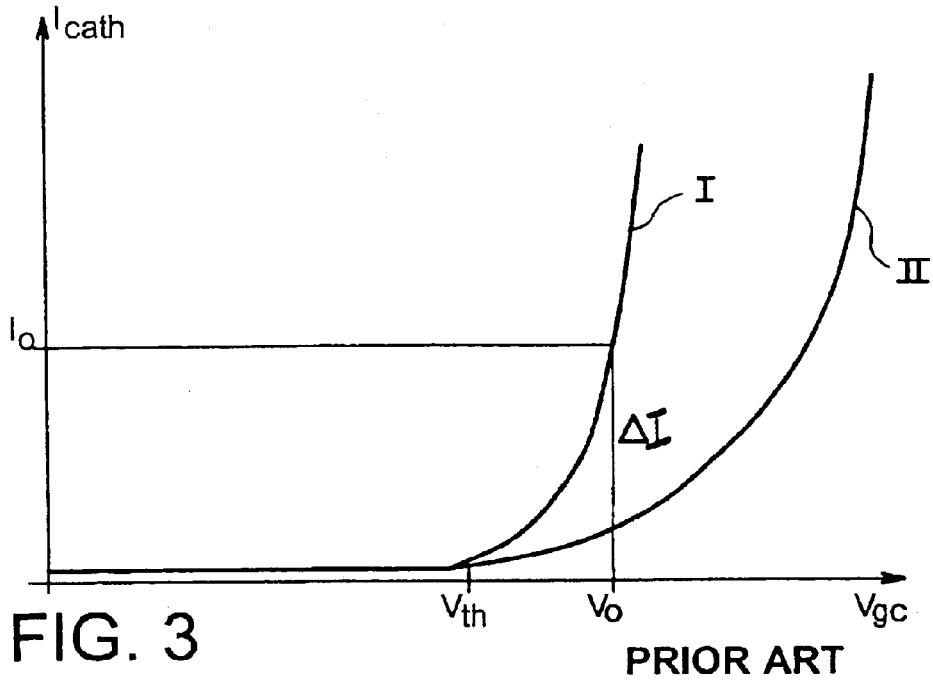

The voltage source 24 enables the high voltage $V_a$ to be applied to the anode conductor 6. Means of polarisation 26 are provided to apply the voltage $V_g$ to the grid of the electron source 2 and the voltage $V_c$ to the cathode of this source. $V_{gc}$ is the control voltage, which is equal to $V_g-V_c$. The characteristics of the cathode $I_{cath}=f(V_{gc})$ are represented in FIG. 3 (curves I and II). $V_{th}$ is the threshold voltage. For a control voltage $V_o$ greater than $V_{th}$, the curve I corresponds to a cathode current $I_o$ whereas the curve II corresponds to a current $I_o$-ΔI.

The electrons emitted by the electron source are accelerated and collected by the anode subjected to the high voltage $V_a$. If one deposits a layer of phosphorous material 28 on the anode conductor 6, the kinetic energy of the electrons is converted into light.

It is possible to produce a display screen by organising the basic assembly of FIG. 1 in the form of a matrix structure. Said matrix structure must enable each pixel of the screen to be addressed and thereby enable the control of its luminance, as described in the document referenced (5).

Figure 4:
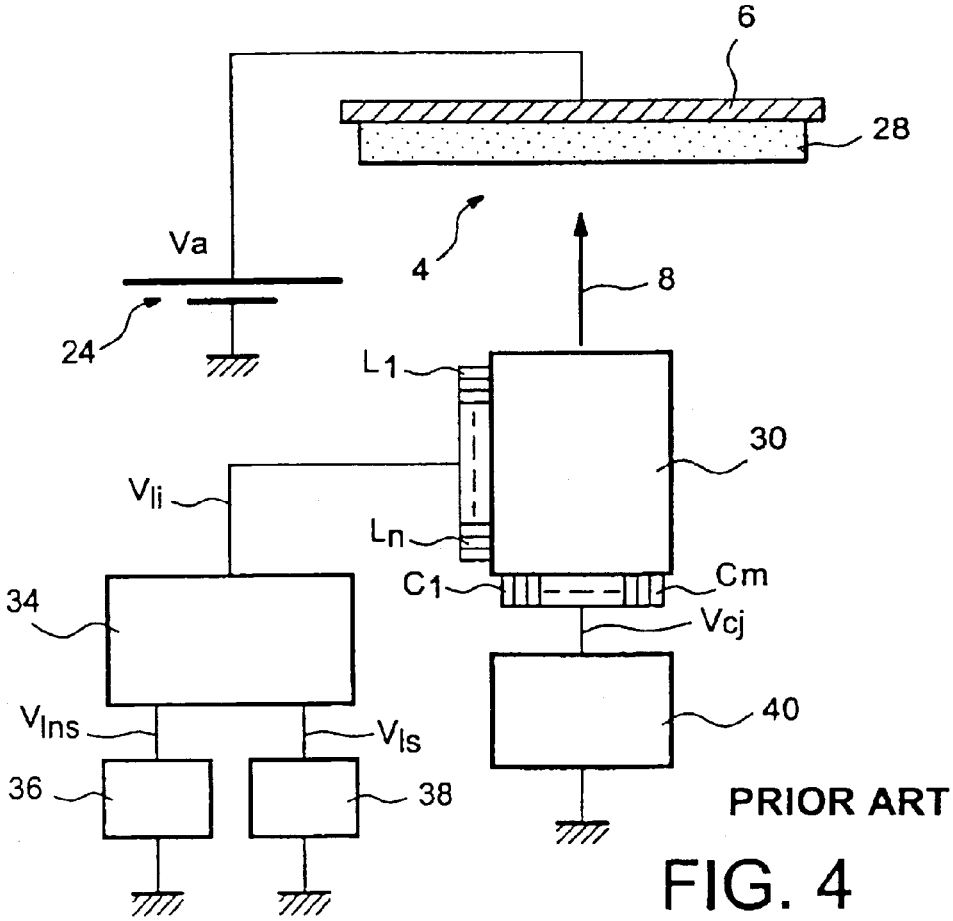

A matrix structure screen using a matrix structure electron source 30 is schematically shown in FIG. 4. Each pixel is defined by the intersection of a line electrode and a column electrode of this source. The line electrodes of this source are designated $L_1, L_2 \ldots L_i \ldots L_n$ and the column electrodes of this source are designated $C_1, C_2 \ldots C_j \ldots C_m$. The screen in FIG. 4 comprises a generator 34 for scanning the lines. Said generator is equipped with a source 36 of voltage $V_{lns}$, and a source 38 of voltage $V_{ls}$. $V_{li}$ is the control voltage of line $L_i$. The screen also comprises means 40 for generating voltages for controlling the columns. $V_{cj}$ is the control voltage for column $C_j$.

More precisely, a control circuit is assigned to each line and to each column of the screen and one line is addressed at a time during a time $t_{lig}$. The lines are sequentially taken to a potential $V_{ls}$ called line selection potential, whereas the columns are taken to a potential corresponding to the information to be displayed. During this time $t_{lig}$, the lines not selected are taken to a potential $V_{lns}$ such that the voltages present on the columns do not affect the display on these lines. In order to obtain grey values, one can act on the value of the control voltages $V_{li}-V_{cj}$ or on their duration $t_{com}$, said duration having to remain less than or equal to $t_{lig}$.

Other control methods are possible. For example, a control method using electric charges, more simply called "charge control method" is known, as described in the document referenced (6). A control method using current, more simple called "current control method" is also known, as described in the document referenced (7).

The following description will cover different control methods and, more specifically, the charge control method.

The control methods mentioned above do not provide a completely satisfactory solution for the control of matrix structure electron sources. One generally needs to obtain a uniform and quantified electron emission that can be attained without major technical constraints.

Voltage control is widely used in these different methods for obtaining the grey levels because it is easy to implement. However, this assumes that the electrical response of the electron source is both stable and uniform. But such conditions of stability and uniformity are difficult to attain in known matrix structure electron sources. In fact, a high uniformity requirement for a screen leads to reject levels that may be considerable. In the same way, one is confronted with differential ageing problems which, by destroying the uniformity of the sources as a function of the more or less repeated use of such or such zone of the source, adversely affect their actual service life.

A current control may seem to resolve this problem because one is then led to injecting a current and thus a specific quantity of electrons. Such a principle is effectively valid in static mode. On the other hand, as soon as one wishes to vary the current of the electron source rapidly, one is confronted with a capacitance loading problem. In tact, a column electrode is like a capacitor in relation to the lines that this column crosses and the current necessary for the rapid charge of this capacitor turns out to be higher, by several orders of magnitude, than the emission current.

By way of example, in a microdot screen with a definition of ¼ VGA (320 columns×240 lines) and a surface area of around 1 $dm^2$, operating under 300 volts of anode voltage, the capacitance of a column in relation to the lines $C_{col}$ is around 400 pF. With a luminance output of 4 lm/w, one has to, if one wants to "light up", in other words excite a pixel with a brilliance of 400 $Cd/m^2$, increase the current of this pixel from a value of virtually zero up to a value of around 30 $\mu$A and, in order to do this, one increases the line-column voltage by around 40 V. If the commutation has to take place in 0.5 $\mu$s (time which is to be compared to a line time of 60 $\mu$s), the capacitance current rises to:

$I=C_{col}.dV/dt$, in other words around 32 mA.

The capacitance current is thus around 1000 times higher than the emission current that one wishes to regulate. It will be understood that such a method is not suitable for the rapid control of a matrix structure electron source.

Figure 5:
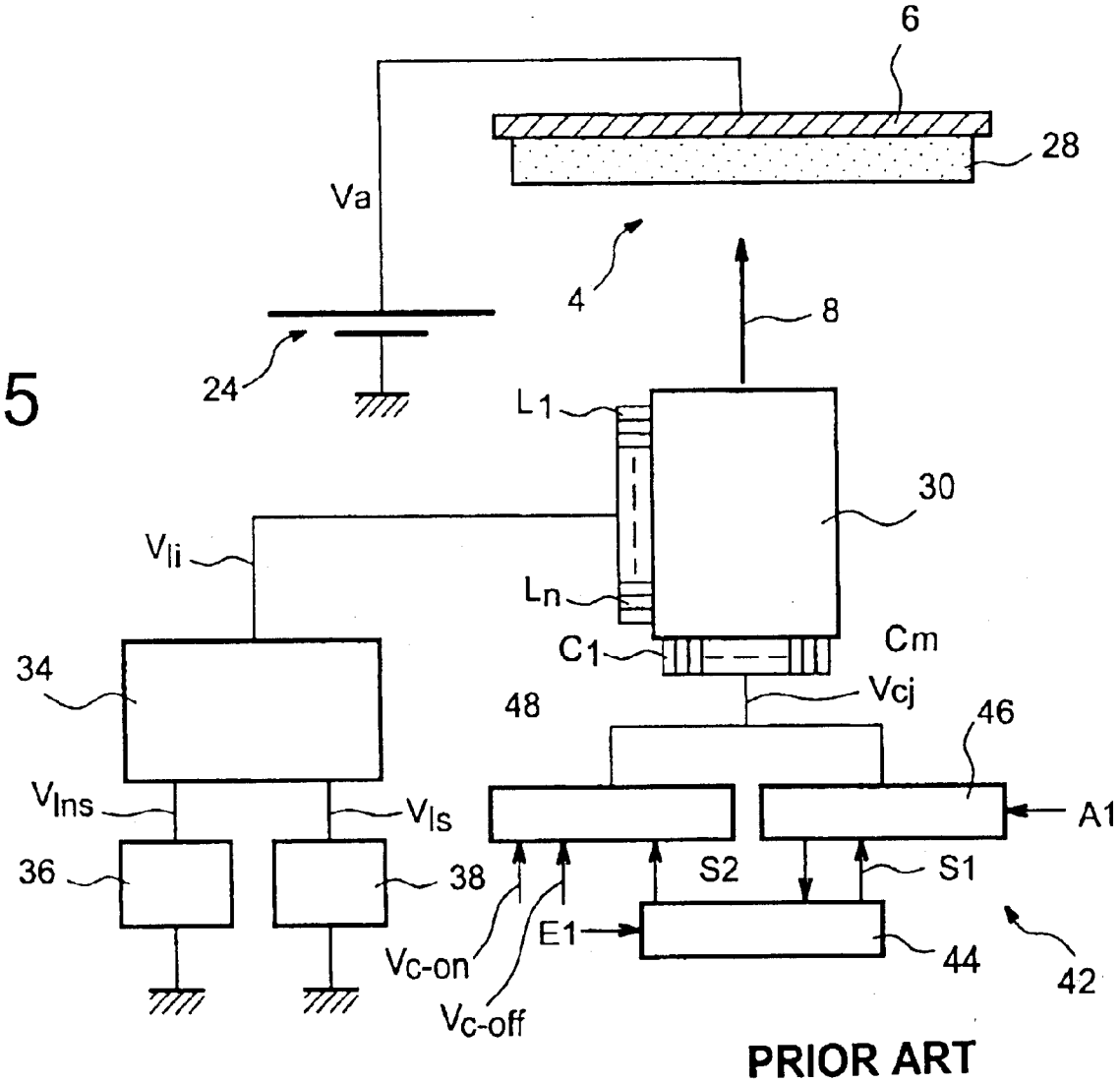

In order to resolve the preceding problem, a charge control has already been proposed in the document referenced (6). FIG. 5 schematically illustrates a display screen comprising a matrix structure electron source using a charge control. This known screen only differs from that in FIG. 4 by the means of applying control voltages to the columns of the source of the screen. In FIG. 5, the means 42 for applying a control voltage to a column, for example the column $C_j$, comprises a logic block 44, which receives in input a line synchronisation signal $E_1$, and a comparator 46, which receives in input a set value A1 and which is linked to the logic block 44. The means for applying voltage 42 also comprise a three phase output stage 48, which is also linked to the logic block 44 and receives voltages respectively designated $V_{c\text{-}on}$ and $V_{c\text{-}off}$ from voltage sources that are not shown. The three phase output stage and the comparator are linked to the corresponding column of the electron source ($C_3$ in the example considered).

In the case of charge control, one pre-charges the considered column conductor in order to ensure the emission of the sources ($V_{c\text{-}on}$). Then, one opens the circuit to allow the capacitor of the column to discharge itself of its internal impedance, up to the point where the floating potential $V_{cj}$ reaches the set value A1 corresponding to the desired quantity of electrons. One then brings the column to the extinction potential ($V_{c\text{-}off}$). Such a way of proceeding assumes the use of components that are equally perfect and its implementation turns out to be difficult.

In fact, we saw above that a column electrode is like a capacitor in relation to the lines of the matrix structure source but that leakage currents also exist that circulate between the considered column and the lines and that these currents vary with the potential difference between these electrodes. As a result, when the circuit is opened, the voltage drop does not depend only on the emission current but also on the leakage currents that themselves vary as a function of this voltage drop.

More precisely, this change in potential is required to measure the charge taken in the capacitance specific to the column but this variation poses a problem. In fact, during the time $t_{lig}$ each of the columns is going to leak in relation to the selected line but also in relation to all of the non-selected lines. Put more simply, one assumes that this defect is like a leakage resistance $R_{lc}$ identical for all of the pixels. This value represents the impedance of the line/column leakage for any line and any column. For one column and during the emission time, this leakage current $I_f$ is expressed in the following manner:

$$I_f=I_{f(ls)}+I_{f(lns)}=(V_{ls}-V_{cj}(t))/R_{lc}+(n-1).(V_{lns}-V_{cj}(t))/R_{lc}$$

Where:

$I_f$=Leakage current of a column in relation to all of the lines $I_{f(ls)}$=Leakage current of a column in relation to the selected line $I_{f(lns)}$=Leakage current of a column in relation to the non-selected lines $V_{ls}$=Potential applied to the selected line $V_{lns}$=Potential applied to the non-selected lines $V_{cj}(t)$=Floating potential in the column j during the emission time n=Number of lines.

Put more simply, one can make $V_{lns}$ equal to 0V and, knowing that $V_{cj}(t)$ is very inferior to $V_{ls}$, we then have:

$I_f=I_{f(ls)}+I_{f(lns)}$ little different to $(V_{ls}/R_{lc})-(n-1).(V_{cj}(t))/R_{lc})$.

This imposes severe constraints on the values $R_{lc}$ of the different columns of the screen. Either the leakage currents are negligible (which corresponds to high $R_{lc}$ values), or they are not completely negligible and then it is necessary to ensure at the least a very good homogeneity of these resistances $R_{lc}$.

One also sees that a single defective pixel from the point of view of $R_{lc}$ imposes its leakage on the whole of the considered column, through the intermediary of the term (n−1) of the equation given above.

In the considered example, the voltage drop of the column due to the emission is equal to:

$\Delta V_{cj}=I.t_{lig}/C_{colb}$ in such a way that, with I=10 $\mu$A, $t_{lig}$=50 $\mu$s and $C_{col}$=400 pF, one obtains $\Delta V_{cj}$=1.25V.

It will be recalled that this variation $\Delta V_{cj}$ must be compared to the set value A1. This voltage variation $\Delta V_{cj}$ depends on the capacitance value of the column, which brings the technological variables of the screen (linked to the dimensions of said screen) into the design parameters of the control circuit. For its implementation, one also sees that the comparator 46 is placed at the level of the output stage of the assembly forming the means of generating control voltages for the columns. This signifies that said comparator must either support the voltage dynamic required to control the columns (around 40 V), or be able to isolate itself from this output by an additional stage.

The aim of the present invention is to overcome the various preceding disadvantages.

DESCRIPTION OF THE INVENTION

The aim of the invention is a method for controlling a matrix structure electron source, said source comprising at least one line and at least one addressing column, the intersection of which defines one or several emissive zones called pixels, said method being a sequential method characterised in that:

firstly, one sets off the emission of electrons by applying potentials on the selected line and the column(s) at a value suited to enabling said emission then one maintains these potentials at their value throughout the duration of the emission, one carries out a sampling and an analog memorisation of the emission current of each pixel of the column(s) concerned, at the start of the emission time, and one uses another current supplied by a current generator that is proportional to the value of the measured emission current circulating in the column(s), and secondly, one measures the quantity of charge delivered, during all or part of the remaining line time, by each current generator, and when this quantity reaches a required value one commutes the potential of the column associated to the current generator to a value that ensures the blockage of the emission of electrons from the pixel of this column.

According to a preferred embodiment of the method according to the invention, the value of the potential of the column(s) suited to enabling the emission, is equal to the potential of the non-addressed line(s) of the pixel of this column.

More precisely, the method according to the invention comprises the following steps:

at the start of the emission time and for each column commuted in emission, one carries out an initial measurement of the current instantly emitted, no commutation taking place on the different lines and columns of the screen during this acquisition, one memorises the sample thus measured, one uses this sample to create a constant current generator, the value of which is proportional to that of said sample, one uses the current generator, and no longer directly the column, to count the charges emitted by the pixel of the considered column, one counts the charges during the emission time, this counting not being perturbed by the injections of current seen by the columns during the commutations that take place on the lines and the columns.

Another aim of the invention is a device for controlling a matrix structure electron source, this source comprising at least one line and at least one addressing column, each intersection of which defines a zone called a pixel, said device being characterised in that it comprises:

means of controlling the addressing line(s) by applying on the selected line a selection potential, whereas outside of the selection time the line(s) remain at a potential that ensures the blockage of the emission of the corresponding pixels, means of controlling the column(s), said means of controlling comprising, for each column, means of applying, during a line selection, either a first voltage ensuring the emission or a second voltage ensuring the blockage of said column, means for measuring the instantaneous current at the start of the emission time and means for using another current supplied by a current generator that is locked to the value of the current measured during the remaining line time, means that make it possible to measure the quantity of charge emitted by the current generator during the emission time, and means for comparing the quantity of charges measured with a quantity of reference charges, with feedback on the means of controlling the columns.

According to a specific embodiment, the quantity of charge measured is converted into a voltage level. The device according to the invention may comprise in addition means for compensating residual leakage currents.

In a first embodiment, the means for measuring the instantaneous current at the start of the emission time and the means for using another current comprise a current-voltage converter, followed by an analog sample and hold device, which makes it possible to memorise, in the form of a voltage, the instantaneous current of the pixel of the considered column.

In a second embodiment, the means for measuring the instantaneous current at the start of the line time and for using another current comprise a current follower assembly and a current copier assembly. Advantageously, the current follower assembly comprises an operational amplifier looped to a first transistor mounted in the feedback of said amplifier, this first transistor being mounted in current follower. The current copier assembly comprises a second transistor polarised by a voltage, these two transistors constituting a current mirror.

The invention makes it possible to obtain:

a total insensitivity of the device that measures and regulates the charge emitted by a pixel, at the commutations, thus at the capacitance couplings of other columns, due to the rapid acquisition at the start of line of the value of the current of the pixel in emission, with memorisation of said value, a simple analog scheme for the regulation of the charge emitted by the pixels, which makes it possible to produce analog charge "driver" devices that are compact, have low consumption and which are inexpensive.

in the second embodiment (illustrated in FIG. 11), one may use a single type of "driver" device for a whole category of screens by playing on the external connection of a certain type of transistor for memorising the pixel current.

BRIEF-DESCRIPTION OF THE DRAWINGS

FIG. 1 schematically illustrates the operating principle of a display screen of the prior art using a field emission device.

FIG. 2 schematically illustrates the structure of a microdot screen of the prior art.

FIG. 3 represents the characteristics $I_{cath}=f(V_{gc})$ in the case of a triode type microdot screen of the prior art.

FIG. 4 schematically illustrates a display screen of the prior art using a matrix structure field emission device.

FIG. 5 is a schematic view of a known device for controlling a matrix structure electron source.

Figure 6:
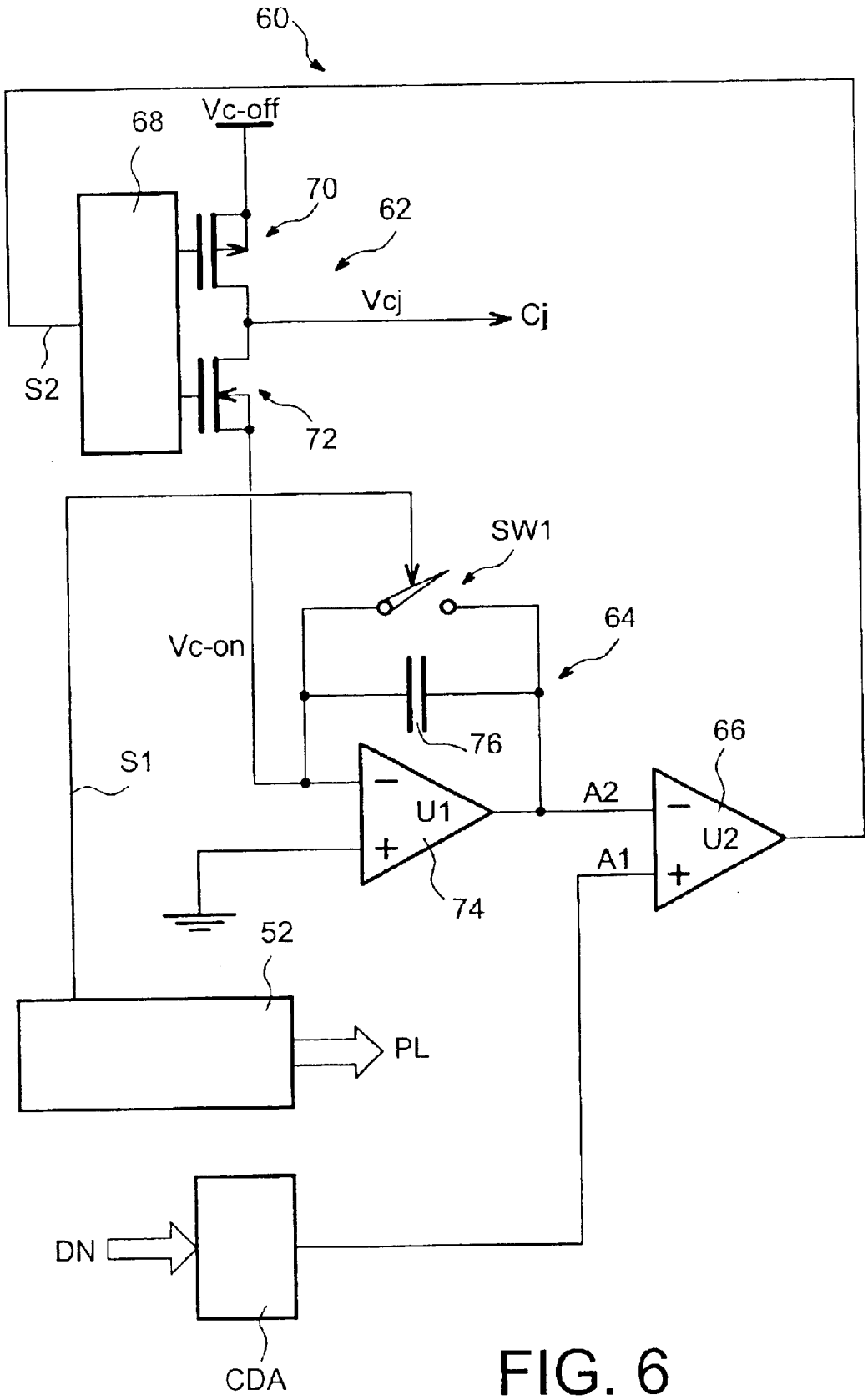

FIG. 6 schematically illustrates an embodiment of the device for controlling a column of a matrix structure electron source.

Figure 7:
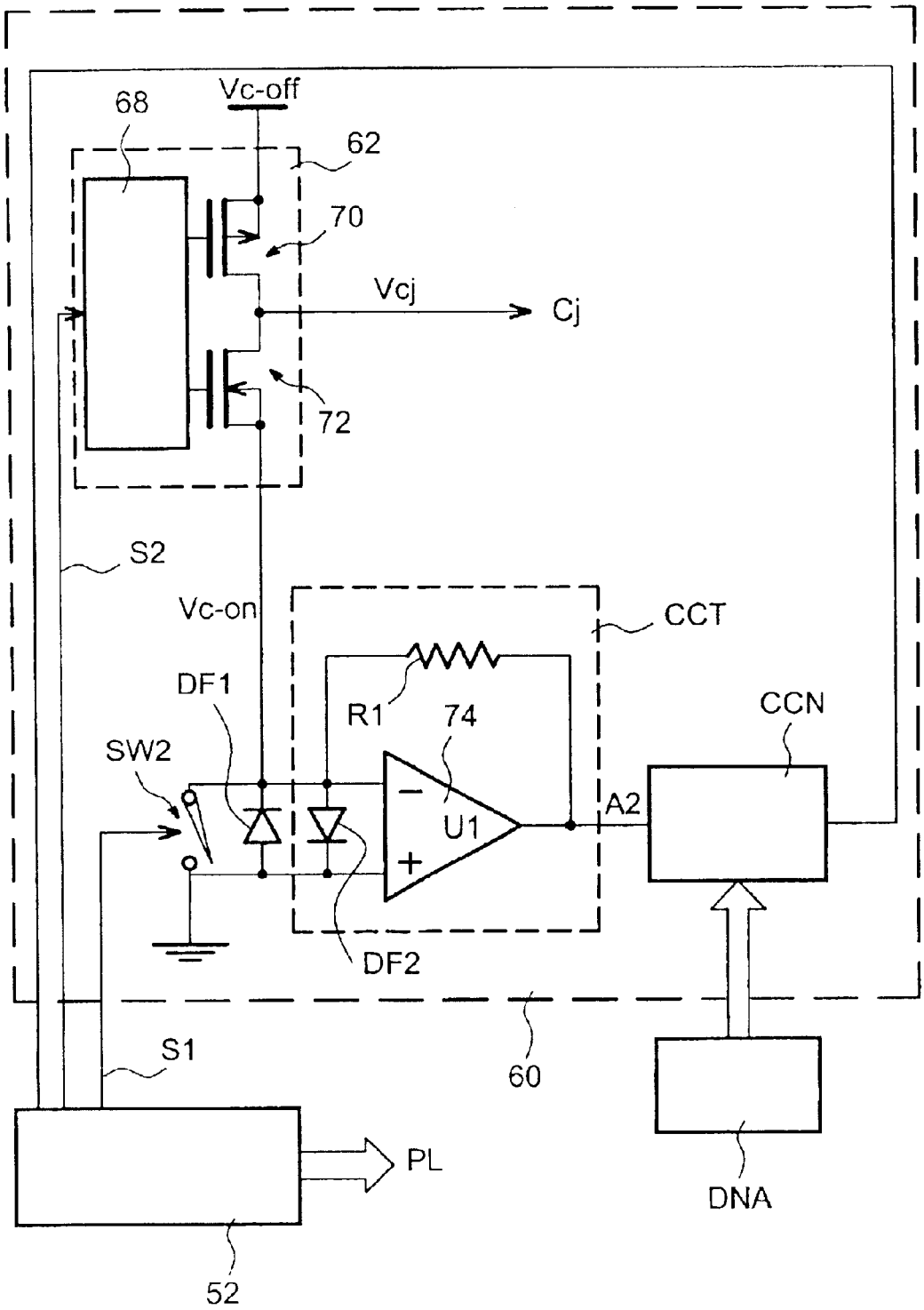

FIG. 7 schematically illustrates another embodiment of the device in FIG. 6.

Figure 8:
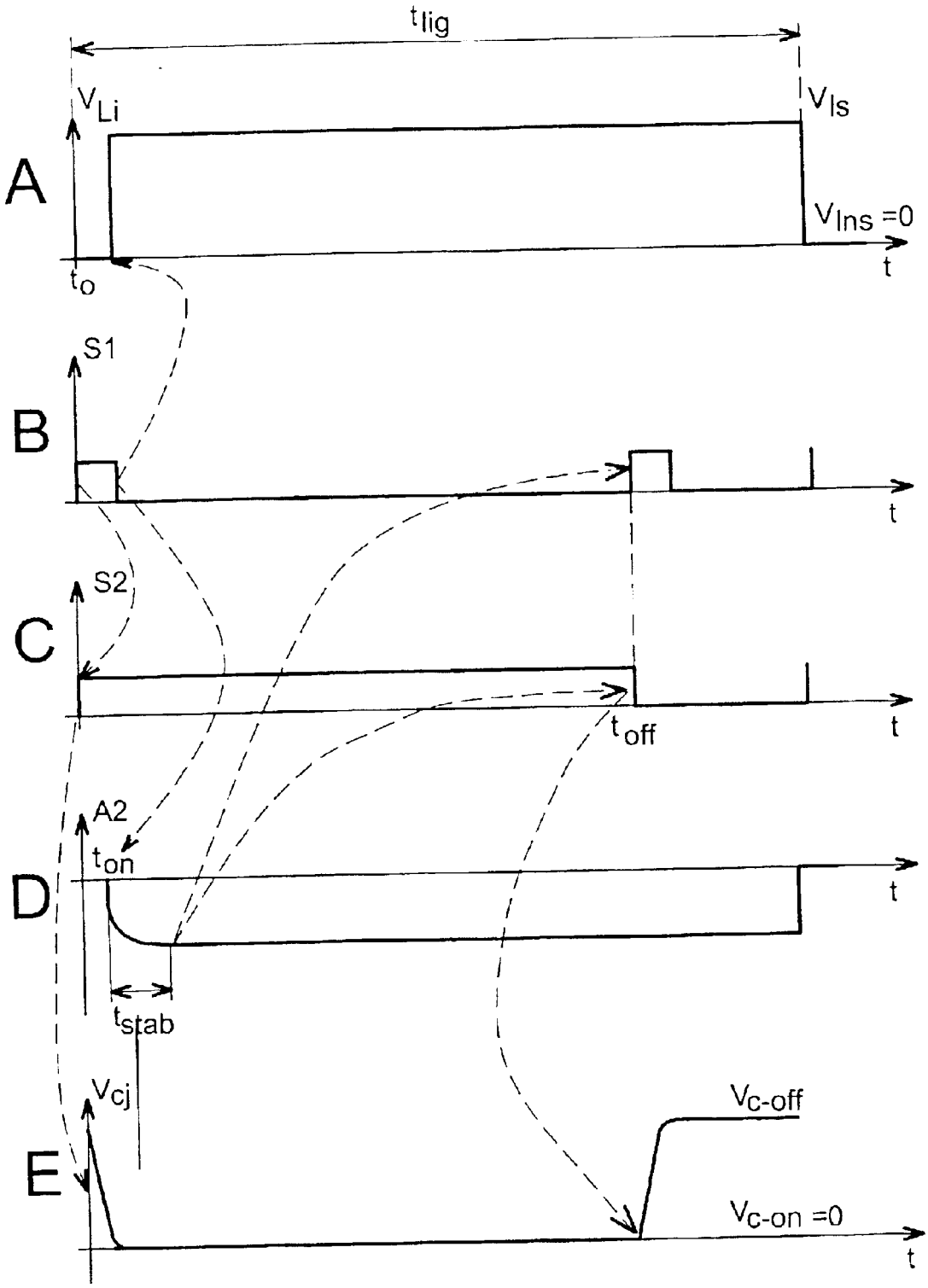

FIG. 8 is a timing chart of the different voltages existing in the device in FIG. 7 during a line addressing cycle.

Figure 9:
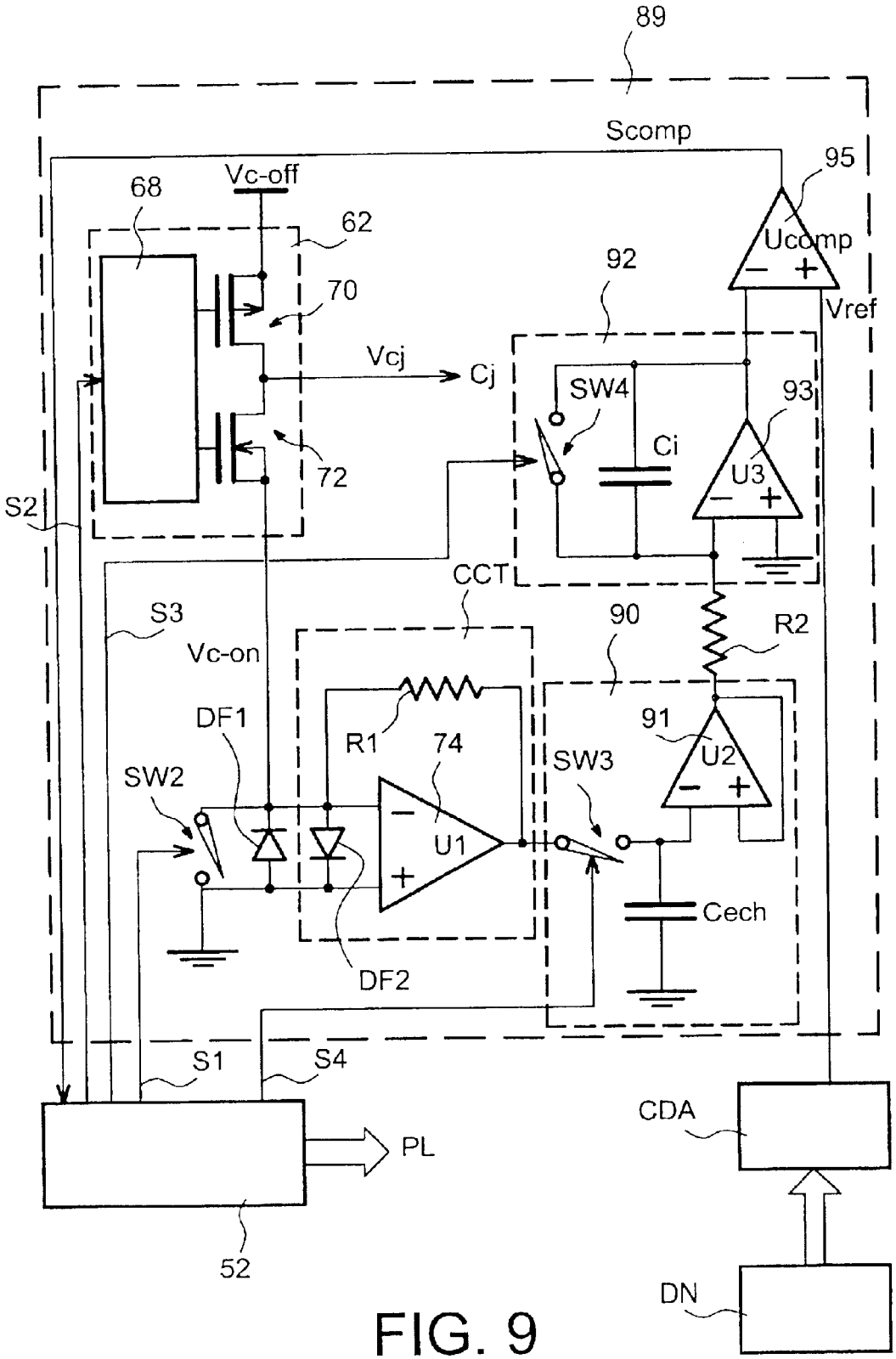

FIG. 9 schematically illustrates a first embodiment, according to the invention, of a device for controlling a column of a matrix structure electron source, with memorisation of the pixel current in the form of voltage.

Figure 10:
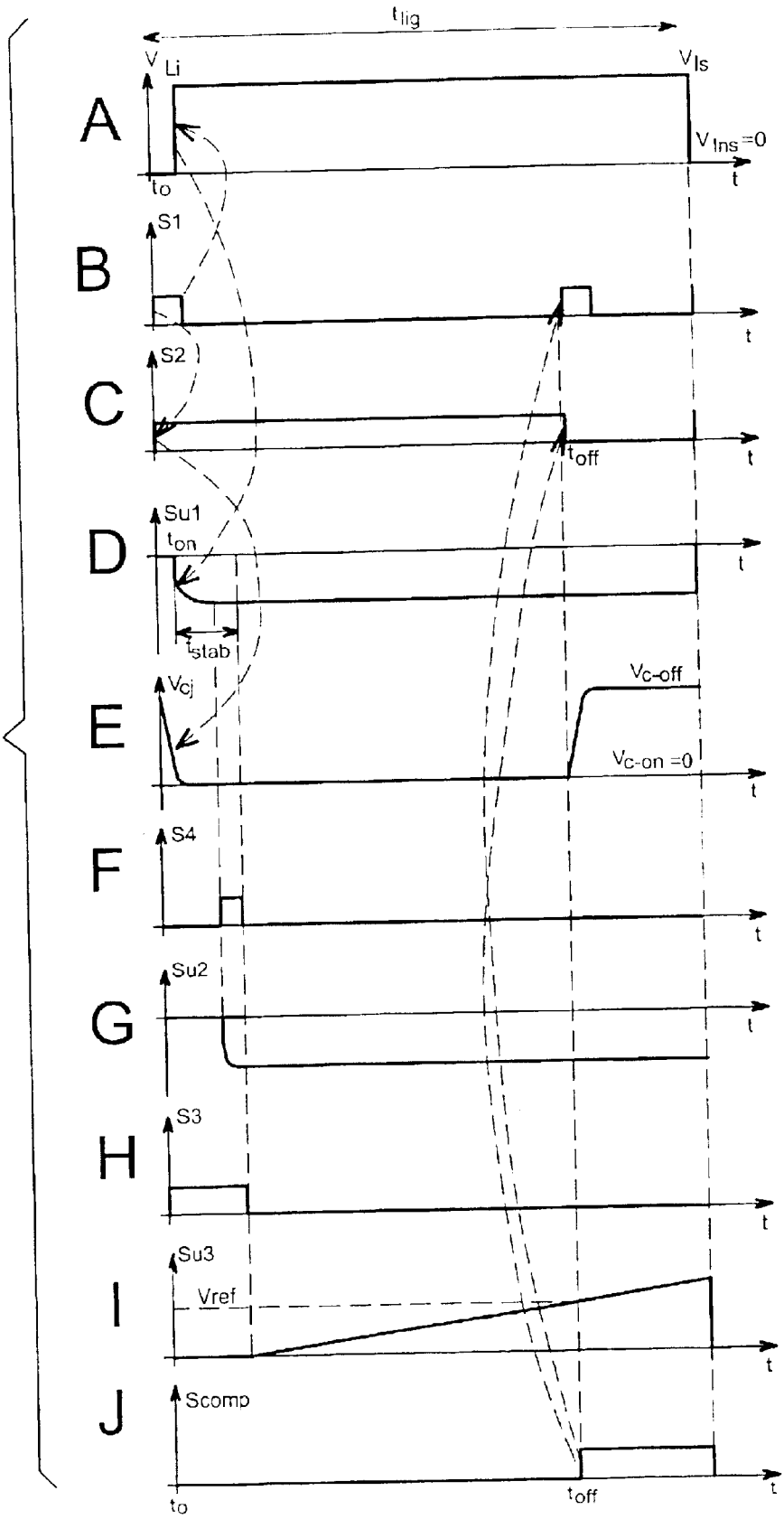

FIG. 10 is a timing chart of the different voltages existing in the device in FIG. 9 during a line addressing cycle.

Figure 11:
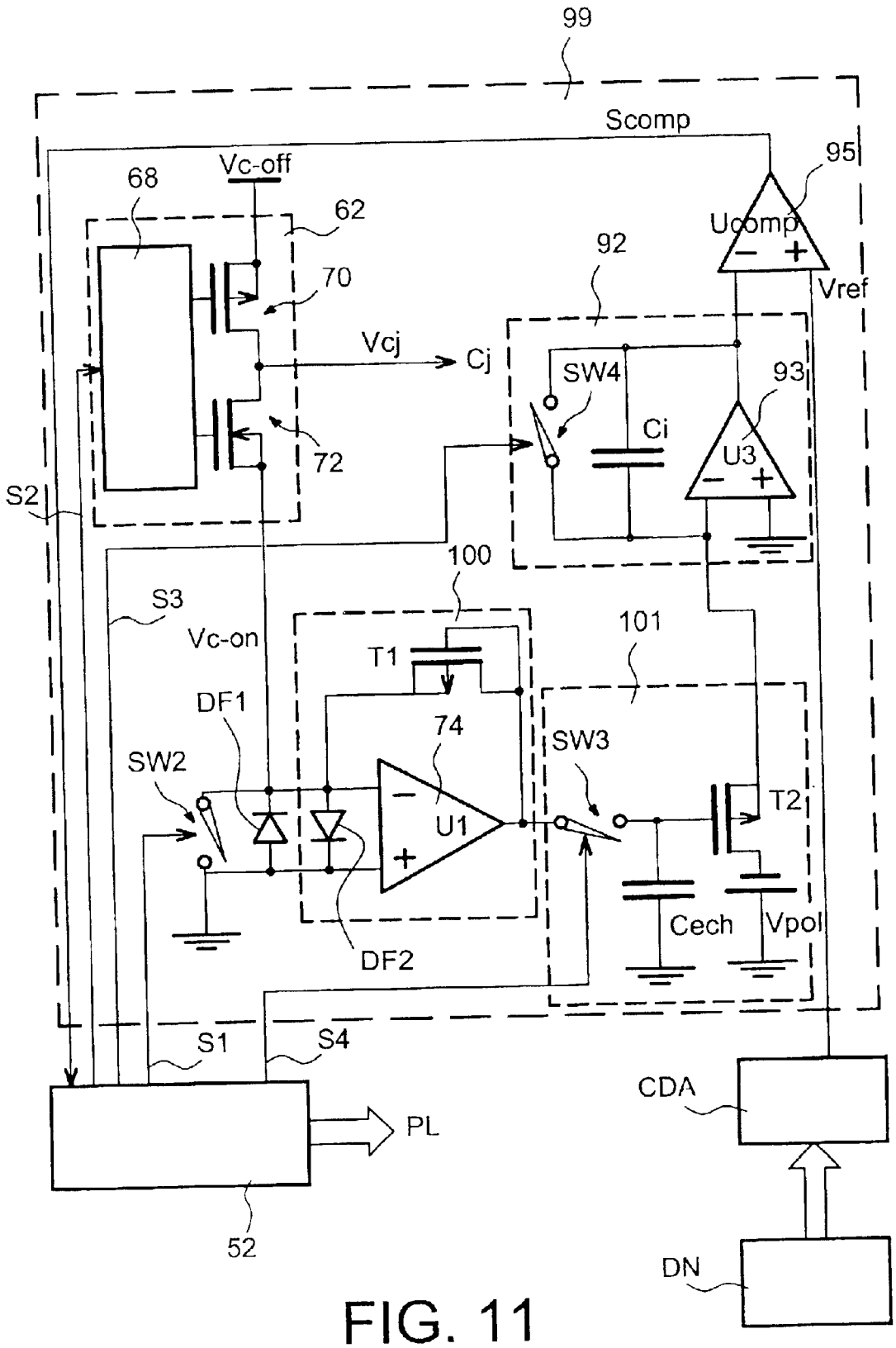

FIG. 11 schematically illustrates a second embodiment, according to the invention, of a device for controlling a column of a matrix structure electron source, with memorisation of the pixel current using a current mirror.

Figure 12:
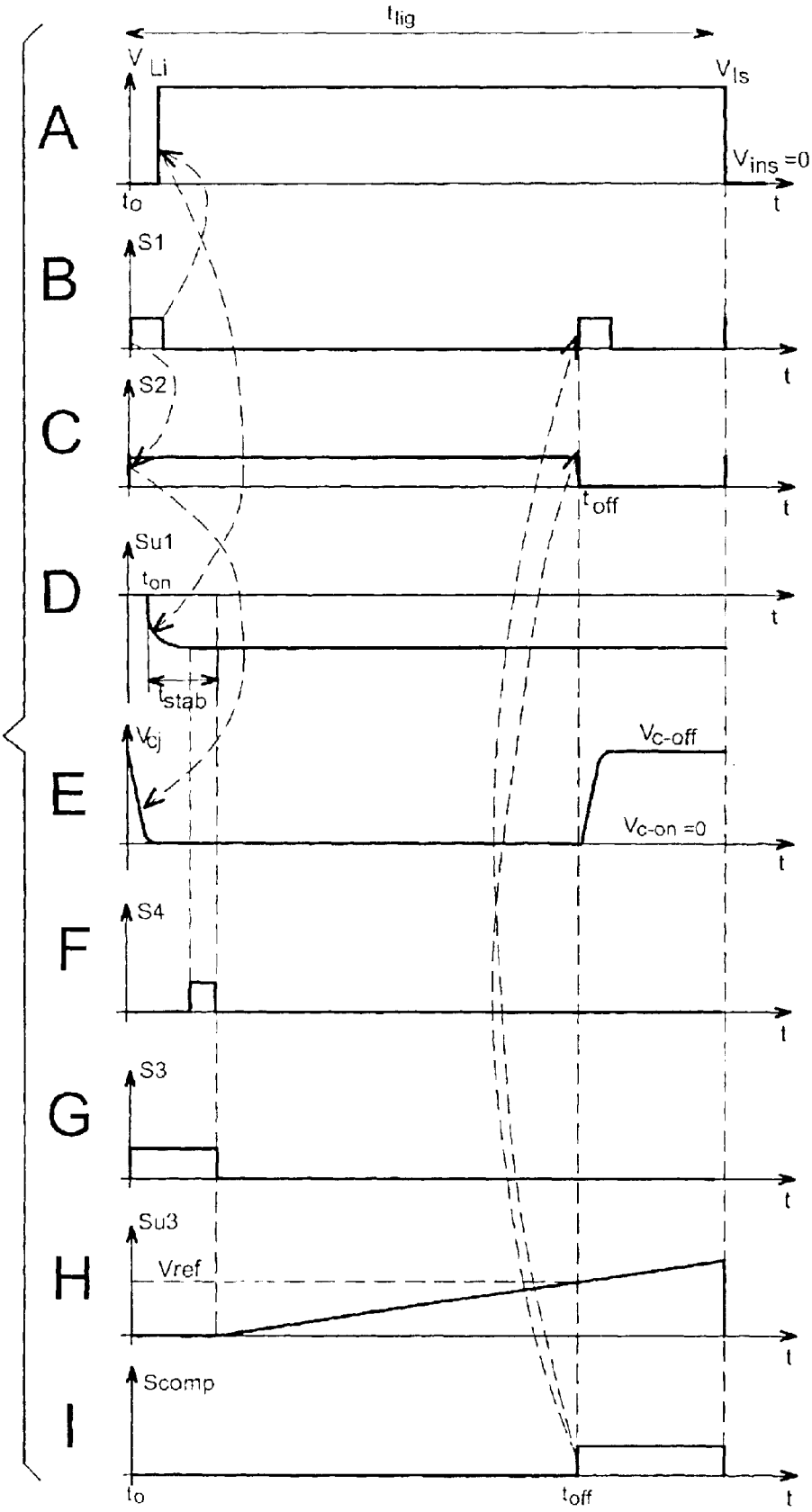

FIG. 12 is a timing chart of the different voltages existing in the device in FIG. 11 during a line addressing cycle.

DETAILED DESCRIPTION OF SPECIFIC EMBODIMENTS

The technique of charge control, which was described here-above and which is also mentioned in the document referenced (6), poses the problem of the change of potential of the controlled columns.

The expression of the leakage current $I_f$ that we saw earlier:

$$I_f=I_{f(ls)}+I_{f(lns)}=(V_{ls}-V_{cj}(t))/R_{lc}+(n-1).(V_{lns}-V_{cj}(t))/R_{lc}$$

highlights the leakage current component in relation to the selected line and the leakage current component in relation to the (n-1) non-selected lines. The first of these components is linked to the principle itself of scanning the screen. The second of these components may be cancelled providing that $V_{cj}$ (t) and $V_{lns}$ are both equal to a same constant.

An embodiment of the device for controlling a column in a device operating in these column conditions is represented in FIG. 6.

This control device 60 comprises a push-pull type output stage 62, a current integrator assembly 64 and a comparator 66.

The output stage 62 makes it possible to commute, on the column electrode ($C_j$), either the supply voltage $V_{c\text{-}off}$ corresponding to the level of extinction of the pixel or the input of the integrator assembly 64 which imposes by its virtual ground the level $V_{c\text{-}on}$, putting it at the potential $V_{lns}$ of the non-selected lines. The output stage 62 comprises, in a manner known to those skilled in the art, means 68 of translating the logic level and two MOSFET transistors 70 and 72, respectively of type P and type N, arranged as shown in FIG. 6.

The integrator assembly 64 comprises an amplifier 74 that is looped on a capacitor 76 of capacitance $C_{int}$ which is itself mounted in parallel with a controlled switch SW1. The output A2 of this amplifier is linked to the input (−) of the comparator 66.

The switch SW1, controlled by a signal S1 corresponding to the start of the time that is allocated to a line, enables the potential A2 to be brought to zero at the start of each line.

The input (+) of the comparator 66 is linked to a set voltage A1 corresponding to the quantity of charges to emit. This set voltage may be supplied by various means that depend on the desired application. In the embodiment represented in FIG. 6, one uses a CDA analog digital converter which receives in input a digital data DN of set voltage and of which the output supplies the set potential A1.

The output S2 of the comparator assembly constitutes the control of the output stage 62 thus enabling the looping of the device.

The control logic 52 supplies the signal S1 and controls a line control circuit PL, which is not represented.

This device converts the quantity of charge already emitted into a voltage level, which makes it possible to switch over the control of the control stage of the column $C_j$ at the moment $t_{off}$ when the quantity of set charge ($Q_{ref}$) is attained.

The charge control method considered enables a charge control at constant column potential and equal to that of the non-selected lines, i.e. $V_{c\text{-}on}=V_{lns}$ which makes it possible to limited the ohmic leakages on any column to the ohmic leakages of the single active pixel of the considered column.

This solution does not however solve the problem of inter-column capacitance couplings. In fact, when the potential of any column j is switched from $V_{c\text{-}on}=V_{Off}$, parasitic charges $Q_{par}=C_{par}\times(V_{c\text{-}on}-V_{c\text{-}off})$ are induced in the neighbouring columns, where $C_{par}$ is the inter-column coupling capacitance. If the neighbouring columns are, at this instant, in emission and in charge regulation, their regulation is perturbed by this charge $Q_{par}$.

In a matrix screen, the inter-column couplings can be broken down into one part due to the intrinsic inter-column influence capacitance, and the other part due to the pixel capacitances in relation to the control lines of the screen. The lines and their associated "driver" devices have an impedance effect that is not equal to zero.

Under these conditions, the lines are no longer equipotential in high frequency and the inter-column couplings appear through them.

The order of magnitude of these parasitic charges is often greater than or equal to that of the useful charges to deliver to the pixel.

If one returns to the example of the microdot screen with a definition of ¼ VGA (320 columns×240 lines) of around 1 $dm^2$ operating under 300 volts of anode voltage, with a luminous output of 4 lm/W, one has to, if one wishes to light up the screen with a brilliance of 400 $Cd/m^2$, increase the current of the pixels from 0 to 30 $\mu$A ($I_{pix}$). For such a screen operating at 70 Hz, the line time is 60 $\mu$s ($t_{line}$). The useful charge to deliver to a pixel is $Q_u$:

$$Q_u=I_{pix}.T_{line}=1.8 \text{ nCB}$$

Given the technology of this screen one evaluates: $Q_{par}\approx 10$ nCB.

These figures illustrate the difficulty one has in regulating $Q_u$ in such a way as to produce, for example, 256 levels of grey. In order to achieve this, one has to filter $Q_{par}$ with an efficiency of ($256\times Q_{par}/Q_u$), i.e. in the case considered, a filtering capacity of 1500.

An embodiment of a device for controlling a column $C_j$., insensitive to the problem of inter-column parasitic coupling mentioned above, is schematically represented in FIG. 7.

This device 60 is based on a rapid acquisition of the current of the pixel at the start of the line time, therefore in the absence of commutation of the other columns. The emission current of a pixel $I_{pix}$ may be considered as constant during a line time when the control voltages do not vary.

One knows the charge $Q_{ref}$ to deliver to the considered pixel from the start of the line time. One can then calculate the time $t_{off}$ at which the column must switch over to the blocking level $V_{c\text{-}off}$ of the emission of the pixel.

This device comprises in particular a push-pull type output stage 62, as represented in the device in FIG. 6, and a CCT current-voltage converter type assembly. Said current voltage converter assembly comprises an amplifier 74 that makes it possible to maintain the potential of the column at that of the virtual ground. The feedback of the amplifier by the resistance R makes it possible to obtain at output A2 a measure of the current of the pixel. The amplifier 74 has, on its inverting input, a controlled switch SW2 and/or rapid switching diodes DF1 and DF2. The role of these components is to evacuate directly to ground the heavy capacitance currents outside of the measuring instances. In fact, during line/column commutations, heavy capacitance currents could perturb the CCT current voltage converter. A CCN digital or analog calculation circuit, which receives digital or analog data from appropriate means DNA, makes it possible to calculate, from the start of the line time, the time $t_{off}$ of column switching, time such that $t_{off}=Q_{ref}/I_{pix}$, the current $I_{pix}$ being stable during the line time.

FIG. 8 represents the time chart of the different voltages existing within the device of FIG. 7, during a line addressing cycle (time $t_{line}$). The cycle starts at time to, by the impulsion of the start of the signal S1, and the rise of the signal S2 which, by the output stage, makes the column go from $V_{cj}$ to $V_c$-on (virtual ground)

At the instant $t_o$ one jointly closes the switch SW2 with the help of the signal S1 to evacuate the capacitance currents of switching the columns. After establishing the potential of the columns $V_{cj}$, one addresses the line i and one jointly opens the switch SW2 with the help of the control S1.

The current of the pixel ($I_{pix}$) establishes on each column, after a stabilisation time $t_{stab}$, a potential level A2 at the output of the amplifier 74. $t_{stab}$ represents the response time of the addressed column or pixel.

From the instant $t_{on}+t_{stab}$ one is in a position, given the charge $Q_{ref}$ to deliver to the pixel, to calculate the instant $t_{off}$ such that:

$$t_{off}=Q_{ref}/I_{pix}$$

This solution makes it possible, from the start of the line time and thus in the absence of commutation parasites from the other columns, to calculate $t_{off}$.

At the instant $t_{off}$, one has an impulsion of the signal S1 and the triggering off of a high to low transition of the signal S2, which, through the intermediary of the output stage 62, imposes the return of $V_{cj}$ to $V_{c\text{-}off}$.

The line potential $V_{li}$ switches towards the selection potential $V_{ls}$, after the establishment of the column potential ($V_{cj}$), which makes it possible to reduce the capacitance to charge uniquely to that of the considered pixel. The capacitance current in the column is thus minimised.

The calculation of $t_{off}$ requires integrating for each column output a rapid calculation electronic 52 to evaluate from the start of the line time, the time $t_{off}$.

The aim of the invention is to propose a simple analog solution for regulating the charge, without means of calculating, which is free of the problems of inter-column parasitic couplings.

The analog solution is based on a sampling and an analog memorisation of the current of each pixel at the start of the line time, which makes it possible to create a system for controlling the charges actually emitted exempt from commutation parasites from the other columns during the remainder of the line time.

Said analog solutions of the problem that needs to be resolved, both simple and integratable, makes it possible to produce analog "driver" devices in charges suited to solving the problems of non-uniformity of emission of the cathodes as well as the problems of marking associated with their operation.

First Embodiment of the Device of the Invention

A first embodiment of the device of the invention 89 is shown in FIG. 9

It comprises several elements of the device shown in FIG. 7. Thus, it comprises:

- the push-pull output stage 62,
- the current-voltage converter CCT, which enables the pixel current to be measured,
- an analog sample and hold device 90, here comprising a switch SW3 controlled by a signal S4 from the control logic 52, a capacitor $C_{ech}$ and an amplifier 91 mounted in voltage follower, which receives the output signal from the current-voltage converter CCT; said analog sample and hold device 90 enables the current of a pixel of the considered column to be memorised in the form of a voltage,
- an integrator 92 comprising an amplifier 93 which, is looped on a condenser C, mounted in parallel with a switch SW4 controlled by a signal S3 from the control logic 52, the input (+) of this amplifier 93 being linked to a fixed voltage, for example the ground,
- a resistance R2 connected on the one hand to the output of the amplifier 91 of the sample and hold device 90 and on the other hand to the input (−) of the amplifier 93 of the integrator 92. This resistance imposes, at the input of the integrator 92, a current proportional to the output voltage of the sample and hold device 90.
- a comparator 95 that receives on its input (−) the output of the amplifier 93 and on its input (+) the output of a digital-analog converter CDA which itself receives in input a number data DN of set voltage.

The "push-pull" output stage 62 makes it possible to switch on the column $C_j$, either the supply voltage $V_{c\text{-}off}$ corresponding to the extinction level of the pixel, or the input of the current-voltage converter CCT imposing by its virtual ground the level $V_{c\text{-}on}$.

One chooses here $V_{lns}=V_{c\text{-}on}$=analog ground.

The current-voltage converter CCT enables the pixel current of the considered column to be measured. The sample and hold device 90 associated with the resistance R2 enables this pixel current to be sampled-blocked.

The output of said integrator 92 (Su3) is a voltage gradient with a slope proportional to the current of the pixel and exempt from all commutation parasites of the neighbouring columns. This gradient is compared to the set charge ($V_{ref}$) supplied to the comparator 95 by the digital analog converter CDA.

Said comparator 95 thus switches over (if R1=R2) at the instant $t_{off}$ such that:

$$t_{off}=Q_{ref}/I_{pix}=C_I.V_{ref}/I_{pix}$$

The output of this comparator 95 (Scomp) is, after processing by the logic 52, re-looped by the signal S2 on the control of the output circuit 62 enabling the control of the considered column.

The device shown in FIG. 9 thus constitutes a looped analog system for regulating the charge emitted.

FIG. 10 represents the time chart of the different voltages existing within said device 89, during a line addressing cycle. The signals A to E in this Figure correspond to the signals A to E in FIG. 8.

The cycle starts at time tog. The low to high transition of the impulsion S1 closes the switch SW2. The low to high transition of S2, thanks to the output stage 62, makes the column potential $V_{cj}$ go to $V_{c\text{-}on}$ (virtual ground).

After a time ton, which enables the column capacitance current to flow through the switch SW2, the signal S1 goes to the low level, which makes it possible to open the switch SW2. There is then an establishment of current $I_{pix}$ in the resistance R1.

The line potential $V_{li}$ goes from its potential $V_{lns}$ (defined as being the ground of the assembly) to the selection potential $V_{ls}$ to trigger off the emission. The current $I_{pix}$ then establishes itself, and after a stabilisation time $t_{stab}$ the output of the current-voltage converter CCT (Su) stabilises at a representative voltage value of $I_{pix}$.

The voltage value is then sampled-blocked in the sample and hold device 90, the switch SW3 of which is controlled by the signal S4 from the logic 52.

From the instant $t_{on}+t_{stab}$, the switch SW4 is opened, thanks to the signal S3 from the logic 52. The integration of the output current of the amplifier 91 ($I_{U2}$) then begins in the capacitor $C_I$ of the integrator 92.

If one chooses R2=R1, one recovers, in the current integrator 92, the value of $I_{pix}$ sampled-blocked at the instant $t_{on}+t_{stab}$. The output of the integrator 92 delivers (Su3) a voltage gradient with a slope proportional to $I_{U2}$, The output of the comparator 95 switches at the instant $t_{off}$ when the voltage gradient on its negative input attains the set value $V_{ref}$ presented on its positive entry.

One has the relation:

$$t_{off}-(t_{on}+t_{stab})=Ci.V_{ref}/I_{pix}.$$

The output of the comparator 95 (Scomp) is then, after processing by the logic 52, re-looped by the signal S2, to stop the emission of the pixel. This signal S2 thus controls the return of the column $V_{cj}$ to $V_{c\text{-}off}$ through the intermediary of the output stage 62.

The device of the invention, as described above, makes it possible to deliver to the considered pixel a charge controlled by the supplied set value $V_{ref}$, and does this without variation in the voltage applied on the column, during the emission time. The device produced in this manner is insensitive to commutations of neighbouring columns thanks to the memorisation of the pixel current.

In this device, the line potential $V_{li}$ switches to the selection potential $V_{ls}$, after the establishment of the potential of the column $V_{cj}$, in such a way as to reduce the capacitance to charge to that of the considered pixel. The capacitance current in the column is thereby minimised during the passing of the pixel in emission, on the low to high transition of $V_{li}$.

The time $t_{stab}$, which corresponds to the establishment of the line/column potential and to the passage of the pixel in emission, is imposed by the physical characteristics of the screen. It sets the first level of grey accessible by the system. Column commutations are prohibited from acquisition and memorisation of the current of the pixel, in effect, during this establishment phase. The charge emitted by the pixel during the time $t_{stab}$ thereby constitutes the first level of grey of the system. The display of the black is managed directly by the control logic 52 by maintaining at the low level the signal S2 of the corresponding column.

As soon as the value of $I_{pix}$ is memorised, at the time $t_{on}+t_{stab}$, it is possible to re-close the switch SW2, which limits the consumption of the amplifier 74.

The proposed device enables the ratio $I_{R2}/I_{pix}$ to be controlled by the choice of the ratio between R1 and R2. The choice of R2 also conditions the geometry of the integration capacitance Ci.

Second Embodiment of the Device of the Invention

FIG. 11 illustrates a second embodiment of the device of the invention 99 based on a memorisation of the current of the pixels by means of a current mirror.

Said device 99 comprises several elements of the device illustrated in FIG. 9, namely:

the output stage 62, the integrator 92, the comparator 95.

Moreover, it comprises:

a current follower assembly 100, a current copier assembly 101.

The current follower assembly 100 comprises the operational amplifier 74 looped on a type P transistor T1 mounted in the feedback of the amplifier 74. Said transistor T1 is mounted in current follower, in other words its gate electrode is connected to its drain electrode and the amplifier 74 output, and its source electrode is connected to the inverting input of the amplifier 74.

The current copier assembly 101 comprises the switch SW3, the capacitor $C_{ech}$ and a transistor T2, identical to the transistor T1, the drain of which is polarised by a voltage $V_{pol}$.

The output of the amplifier 74 ($S_{ul}$) controls the transistor gate T2. The transistor T2 thus copies the current of T1, itself identical to the pixel current. The assembly T1, T2 constitutes a current mirror.

The drain of T1 could also be polarised by means of the voltage $V_{pol}$.

The current copier assembly 101 enables the sampling and the blocking of the current $I_{pix}$ in the transistor T2. The current of T2 is exempt of all commutation parasites from the neighbouring columns.

The output of the integrator 92 is a voltage gradient with a slope proportional to the current of the transistor T2 and thus to that of the pixel. This gradient is compared to the set charge supplied to the comparator by the digital analog converter CDA. Said comparator 95 thus switches at the instant $t_{off}$, such that:

$$T_{off}=Q_{ref}/I_{pix}=C_I.V_{ref}/I_{pix}$$

The output of this comparator 95 is, after processing by the logic 52, re-looped by the signal S2 on the control of the output circuit 62 enabling the control of the considered column.

The device thus represented constitutes a looped analog system for controlling the charge emitted.

FIG. 12 represents the time chart of different voltages within the device 99 illustrated in FIG. 11. The signals A to I in this Figure correspond respectively to the signals A to F and H to J in FIG. 10.

The cycle starts at time $t_o$ by S1 passing to the high level which closes the switch SW2 and by the low to high transition S2 which, by the output stage 62, makes the potential go from $V_{cj}$ to $V_{c\text{-}on}$ (virtual ground).

After a time $t_{on}$, which enables the column capacitance current to flow through the switch SW2, and thus to $V_{cj}$, to establish itself at the voltage $V_{c\text{-}on}$, the signal S1 goes to the low level to open the switch SW2. This allows the current $I_{pix}$ to be established in the transistor T1.

To trigger off the emission, $V_{li}$ goes from its potential $V_{ins}$ (defined as being the ground of the assembly) to the selection potential $V_{ls}$. The current $I_{pix}$ then establishes itself and, after a stabilisation time $t_{strab}$ the output voltage ($S_{ul}$) of the current follower 100 stabilises at the value required for passing to the current $I_{pix}$ in the transistor T1 and, as a consequence, in the transistor T2.

This voltage value ($S_{ul}$) is then sampled-blocked by means of the control S4, in $C_{ech}$.

From the instant $t_{on}+t_{stab}$ one opens the switch SW4 through the intermediary of the signal S3 which starts the integration of the output current of the transistor T2 in the capacitance Ci of the integrator 92.

With two identical transistors T1 and T2, one recovers in the current integrator 92, the value of $I_{pix}$ sampled-blocked at the instant $t_{on}+t_{stab}$. The output of the integrator 92 delivers ($S_{u3}$) a voltage gradient of slope proportional to the output current of the transistor T2 ($I_{T2}$).

The output of the comparator 95 (Scomp) switches at $t_{off}$ when the voltage gradient on its input attains the set value $V_{ref}$ presented on the input (+)

One has the relation:

$$t_{off}-(t_{on}+t_{stab})=Ci.V_{ref}/I_{pix}.$$

The output of the comparator 95 (Scomp) is then revalidated by the logic 52, to stop the emission of the pixel. The control S2 then controls the return of the column voltage $V_{cj}$ to $V_{f\text{-}off}$ through the intermediary of the output stage 62.

The device described here-above, makes it possible to deliver to the considered pixel, a charge controlled by the supplied set value $V_{ref}$, and it does this without variation of the voltage applied on the column during the emission time. It is also insensitive to the commutations of neighbouring columns thanks to the memorisation of the current of the pixel.

In this case, the line potential $V_{li}$ also switches to the selection potential $V_{ls}$, after the establishment of the potential of the column ($V_{cj}$), in such a way as to reduce the capacitance to charge to that of the considered pixel.

Said proposed device enables the ratio $I_{T2}/I_{pix}$ to be controlled by the choice of the geometric ratios between the transistor T1 and the transistor T2. The geometry of the transistor T2 also determines the geometry of the integration capacitance Ci. Said device also offers the freedom of having a choice of several transistors T2 of different geometries installed in parallel in the circuit. The choice of transistor to use depends on the type of screen to control (thus of the expected $I_{pix}$) by connecting the shared drains of the chosen family to the supply $V_{pol}$. This connection is made outside of the circuit when using it on a given type of screen.

REFERENCES

[1]"Ecrans fluorescents a micropointes", R. Baptist (L'Onde Electrique, November–December 1991, volume 71, no 6, pages 36–42).

[2]"Flat panel displays based on surface conduction electron emitters", K. Sakai et al. (Proceedings of the 16$^{th}$ international display research conference, ref. 18. 3L, pages 569–572).

[3]"Carbon nanotube FED elements", S. Uemura et al. (SID 1998 Digest, pages 1052–1055).

[4]"Recent progress in field emitter array development for high performance applications", Dorota Temple (Materials science & engineering, vol. R24, no 5, January 1999, pages 185–239).

[5]"Microtips displays addressing", T. Leroux et al. (SID 91 Digest, pages 437–439).

[6]FR 2632436.

[7]U.S. Pat. No. 5,359,256.

What is claimed is:

1. Method for controlling the voltage of a matrix structure electron source, said source comprising at least one line and at least one addressing column, the intersection of which defines one or several emissive zones called pixels and where the electrons are supplied by the column, said method being at sequential method, characterised in that:

firstly, setting the emission of electrons by applying potentials on the selected line and the column(s) at a value suited to allowing this emission and then maintaining these potentials at their value throughout the duration of the emission, carrying out a sampling and an analog memorisation of the emission current of each pixel of the column(s) concerned, at the start of the emission time, and using another current supplied by a current generator that is proportional to the value of the measured emission current circulating the column(s), and secondly, measuring the quantity of charge delivered, during all or part of the remaining line time, by each current generator, and when this quantity reaches a required value, commuting the potential of the column associated to the current generator to a value that ensures the blocking of the emission of electrons of the pixel of this column.

2. Method according to claim 1, in which the value of the potential of the column(s) suited to enabling the emission of electrons is equal to the potential of the non-addressed line(s).

3. Method according to claim 1, which comprises the following steps:

at the start of the line time and for each column commuted in emission, carrying out an initial measurement of the current instantaneously emitted, no commutation taking place on the different lines and columns of the screen during this acquisition, memorizing the sample thus measured, using this sample to create a constant current generator, the value of which is proportional to that of said sample, using the current generator, and no longer directly the column, to count the charges emitted by the pixel of the considered column, counting the charges during the remainder of the emission time, this counting not being perturbed by the injections of current seen by the columns during the commutations that take place on the lines and the columns.

4. Device for controlling a matrix structure electron source, this source comprising at least one line and at least one addressing column, each intersection of which defines a zone called a pixel and where the electrons are supplied by the column, said device being characterised in that it comprises:

means of controlling the addressing line(s) by application on the selected line a selection potential, whereas outside of the selection time the line(s) remain at a potential that ensures the blockage of the emission of the corresponding pixels, means of controlling the column(s), said means of controlling comprising, for each column, means of applying, during a line selection, either a first voltage ensuring the emission or a second voltage ensuring the blockage of said column, means for measuring the instantaneous current at the start of the emission time and means for using another current supplied by a current generator that is proportional to the measured current value, means that make it possible to measure the quantity of charges emitted by the current generator during the emission time, and means for comparing the quantity of charges measured with a quantity of reference charges, with feedback on the means of controlling the columns.

5. Device according to claim 4, in which the quantity of charge measured is converted into a voltage level.

6. Device according to claim 4, comprising in addition means for compensating residual leakage currents.

7. Device according to claim 4, in which the means for measuring the instantaneous current of a pixel at the start of the emission time and the means for using another current comprise a current-voltage converter, followed by an analog sample and hold device (90), which makes it possible to memorise, in the form of a voltage, the instantaneous current of the pixel of the considered column.

8. Device according to claim 4, in which the means for measuring the instantaneous current at the start of the line time and for using another current comprise a current follower assembly (100) and a current copier assembly (101).

9. Device according to claim 8, in which the current follower assembly (100) comprises an operational amplifier (74) looped on a first transistor (T1) mounted in the feedback of said amplifier, this first transistor (T1) being mounted in current follower, and in which the current copier assembly (101) comprises a second transistor (T2) polarised by a voltage (Vpol), these two transistors (T1, T2) constituting a current mirror.

* * * * *